US007708389B2

(12) United States Patent
Murai

(10) Patent No.: US 7,708,389 B2
(45) Date of Patent: May 4, 2010

(54) LIQUID EJECTION HEAD

(75) Inventor: Masami Murai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 10/491,827

(22) PCT Filed: Jul. 8, 2003

(86) PCT No.: PCT/JP03/08667

§ 371 (c)(1),
(2), (4) Date: Mar. 4, 2005

(87) PCT Pub. No.: WO2004/005032

PCT Pub. Date: Jan. 15, 2004

(65) Prior Publication Data

US 2005/0157093 A1 Jul. 21, 2005

(30) Foreign Application Priority Data

Jul. 9, 2002 (JP) ..... 2002-200599

(51) Int. Cl.
*B41J 2/045* (2006.01)

(52) U.S. Cl. ..... 347/69; 347/70

(58) Field of Classification Search ..... 310/324, 310/328; 347/68–72
See application file for complete search history.

(56) References Cited

U.S. PATENT DOCUMENTS

| | | | | |
|---|---|---|---|---|
| 5,774,961 | A | 7/1998 | Takeuchi et al. | |
| 6,140,746 | A * | 10/2000 | Miyashita et al. | 310/358 |
| 6,276,772 | B1 * | 8/2001 | Sakata et al. | 347/10 |
| 6,604,802 | B2 * | 8/2003 | Horio et al. | 347/11 |
| 6,609,785 | B2 * | 8/2003 | Hashizume et al. | 347/70 |
| 6,824,254 | B2 * | 11/2004 | Koike et al. | 347/71 |
| 6,949,869 | B2 * | 9/2005 | Junhua et al. | 310/328 |
| 2002/0008743 | A1 * | 1/2002 | Murai | 347/71 |
| 2002/0071008 | A1 * | 6/2002 | Hashizume et al. | 347/70 |

FOREIGN PATENT DOCUMENTS

| | | |
|---|---|---|
| EP | 0 963 846 A2 | 12/1999 |
| EP | 1 137 078 A2 | 9/2001 |
| JP | 11-058730 | 3/1999 |
| JP | 11-058730 A | 3/1999 |

(Continued)

OTHER PUBLICATIONS

Patent Abstract of Japan publication with English translation of abstract for JP 2001-274472.

(Continued)

*Primary Examiner*—Matthew Luu
*Assistant Examiner*—Lisa M Solomon
(74) *Attorney, Agent, or Firm*—Sterne, Kessler, Goldstein & Fox P.L.L.C.

(57) ABSTRACT

A liquid jetting head using a piezoelectric element that is capable of obtaining sufficient displacement through the application of a driving voltage is provided. In the liquid jetting head, which comprises a substrate formed with a pressure chamber, a diaphragm formed on the substrate, and a piezoelectric thin film element formed on the diaphragm, the diaphragm bends in convex form toward the pressure chamber side, and the amount by which the diaphragm bends is no more than 0.4% of the width of the pressure chamber.

9 Claims, 5 Drawing Sheets

FOREIGN PATENT DOCUMENTS

| | | | | |
|---|---|---|---|---|
| JP | 11058730 | A | * | 3/1999 |
| JP | 2001-274472 | | | 10/2001 |
| JP | 2002316416 | A | * | 10/2002 |

OTHER PUBLICATIONS

Patent Abstract of Japan publication with English translation of abstract for JP 11-058730.

International Search Report for International Application No. PCT/JP03/008667; international filing date Jul. 8, 2003.

Supplemental European Search Report for European Application No. EP 03 74 1277, European Patent Office, mailed Apr. 14, 2009, 3 pgs.

Patent Abstract of Japan publication with English translation of abstract for JP 2001-274472, Oct. 5, 2001.

Patent Abstract of Japan publication with English translation of abstract for JP 11-058730, Mar. 2, 1999.

International Search Report for International Application No. PCT/JP03/008667; international filed Jul. 8, 2003.

* cited by examiner

1: INKJET RECORDING HEAD

LIQUID EJECTION HEAD

TECHNICAL FIELD

The present invention relates to a liquid jetting head, and more particularly to a liquid jetting head formed with a piezoelectric element and a pressure chamber whose volume is increased and decreased thereby.

BACKGROUND ART

A liquid jetting head uses a driving element such as a piezoelectric element to discharge ink or another liquid from a pressure chamber. The piezoelectric element comprises a piezoelectric film interposed between top and bottom electrodes. By applying a driving voltage to the electrodes, warping is produced such that the volume of the pressure chamber alters, and thus the liquid inside the cavity can be discharged. As liquid jetting heads become smaller, demands are being made for reductions in the film thickness of the piezoelectric film and the size of other parts.

In a liquid jetting head having a piezoelectric film that has been reduced in thickness, however, the diaphragm and piezoelectric film sometimes remain bent even when the voltage applied to the piezoelectric film is reduced to zero. It has been conjectured that one of the causes of this bending is that the effect of internal stress occurring in the diaphragm and piezoelectric film increases relative to reductions in the film thickness. When the diaphragm and piezoelectric film are bent in this manner, sufficient displacement cannot be obtained when a driving voltage is applied. It is possible that this problem will grow as the film thickness and size of liquid jetting heads continue to be reduced, and hence a solution is desirable in order to develop future liquid jetting heads.

An object of the present invention is to solve the problem described above by providing a liquid jetting head using a piezoelectric element that is capable of obtaining sufficient displacement through the application of a driving voltage.

DISCLOSURE OF THE INVENTION

In order to solve the aforementioned problems, the present invention is a liquid jetting head comprising a substrate formed with a pressure chamber, a diaphragm formed on the substrate, and a piezoelectric thin film element formed on the diaphragm, characterized in that the diaphragm bends in convex form toward the pressure chamber side, and the amount by which the diaphragm bends is no more than 0.4% of the width of the pressure chamber.

In this liquid jetting head, the piezoelectric thin film element preferably comprises a piezoelectric thin film constituted by PZT with a degree of (100) face orientation of at least 70%.

In this liquid jetting head, the piezoelectric thin film element preferably comprises a piezoelectric thin film constituted by multi-component PZT containing at least $Pb(Zn_{1/3}Nb_{2/3})O_3$.

In this liquid jetting head, the part of the diaphragm for forming the pressure chamber may be formed more thinly than the other parts.

In this liquid jetting head, the piezoelectric thin film element preferably comprises a piezoelectric thin film having a film thickness of no less than 0.5 μm and no more than 2.0 μm.

A liquid discharging device of the present invention is characterized in being constituted to be capable of discharging ink from the aforementioned liquid jetting head.

Figure 1:
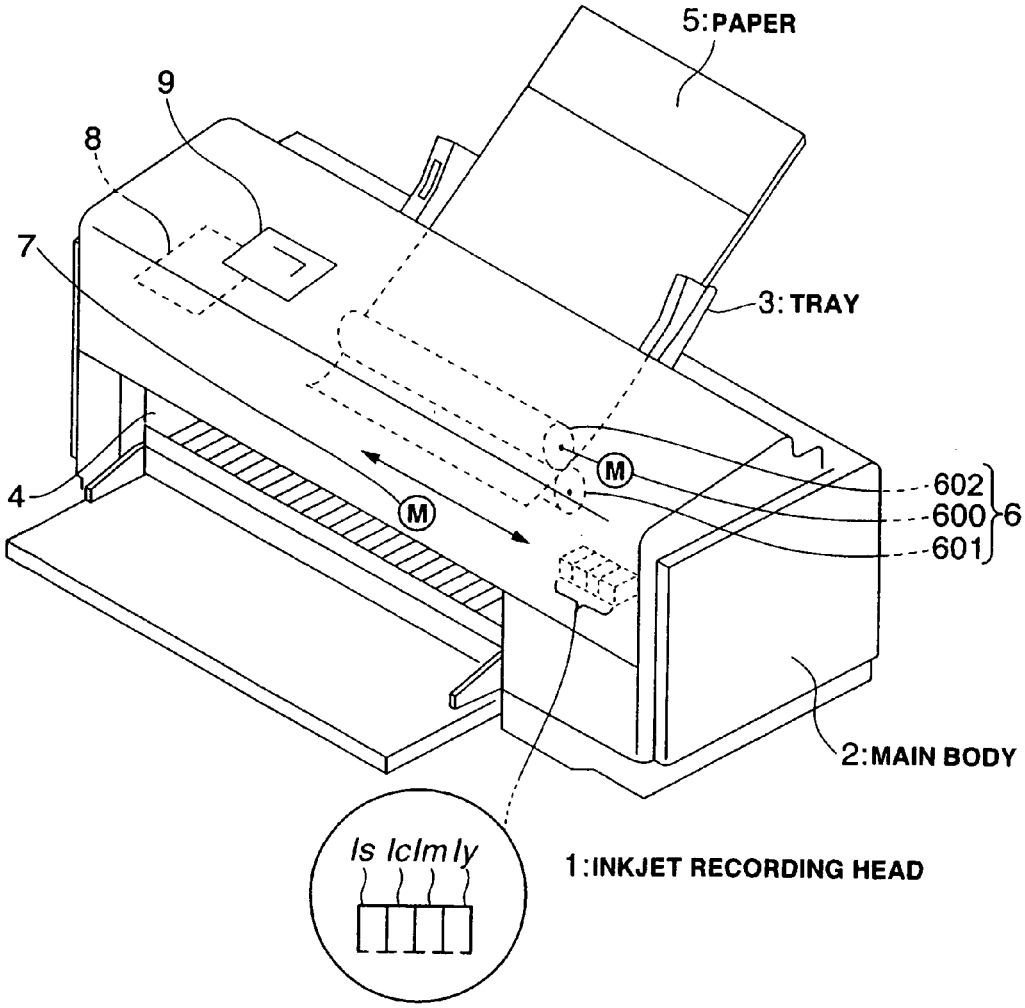
FIG. 1 is a perspective view illustrating the constitution of a printer in which a liquid jetting head according to an embodiment of the present invention is used.

Note that in the drawings, the reference symbol 20 refers to a pressure chamber substrate, 30 to a diaphragm, 31 to a first oxide film, 32 to a second oxide film, 40 to a piezoelectric thin film element, 42 to a bottom electrode, 43 to a piezoelectric thin film, 44 to a top electrode, S to bending, and W to cavity width.

BEST MODE FOR CARRYING OUT THE INVENTION

A preferred embodiment of the present invention will be described below with reference to the drawings.

[1. Overall Constitution of Inkjet Printer]

FIG. 1 is a perspective view illustrating the constitution of a printer serving as an example of a liquid discharging device in which the liquid jetting head of this embodiment is used. The printer is provided with a main body 2, a tray 3, a discharge port 4, and an operating button 9. The interior of the main body 2 further comprises an inkjet recording head 1, a paper supply mechanism 6, and a control circuit 8.

The inkjet recording head 1, which serves as a liquid jetting head, comprises a plurality of piezoelectric elements formed on a substrate, and is constituted to be capable of discharging ink from a nozzle in response to a discharge signal issued from the control circuit 8.

The main body 2 is the casing of the printer. The paper supply mechanism 6 is disposed in a position allowing paper 5 to be supplied from the tray 3, and the inkjet recording head 1 is disposed such that printing can be performed on the paper 5. The tray 3 is constituted to be capable of supplying the paper 5 to the paper supply mechanism 6 prior to printing, and the discharge port 4 is an outlet through which the paper 5 is discharged when printing thereon is complete.

The paper supply mechanism 6 comprises a motor 600, rollers 601, 602, and other mechanical constructions not shown in the drawing. The motor 600 is capable of rotation in response to a driving signal issued from the control circuit 8. The mechanical constructions are constituted to be capable of transmitting the rotary force of the motor 600 to the rollers 601, 602. When the rotary force of the motor 600 is transmitted to the rollers 601, 602, the rollers 601, 602 rotate, and by means of this rotation, the paper 5 that is placed on the tray 3 is drawn in and supplied so as to be printable by the head 1.

The control circuit 8 comprises a CPU, ROM, RAM, an interface circuit, and so on, not shown in the drawing, and is capable of issuing driving signals to the paper supply mechanism 6, issuing discharge signals to the inkjet recording head 1, and so on in accordance with printing information supplied from a computer via a connector not shown in the drawing. The control circuit 8 is also capable of performing operation mode setting, reset processing, and so on in accordance with operating signals from the operating panel 9.

The printer of this embodiment comprises the liquid jetting head to be described below, which is capable of obtaining sufficient displacement, and hence is a high-performance printer.

[2. Constitution of Ink Jet Recording Head]

Figure 2:
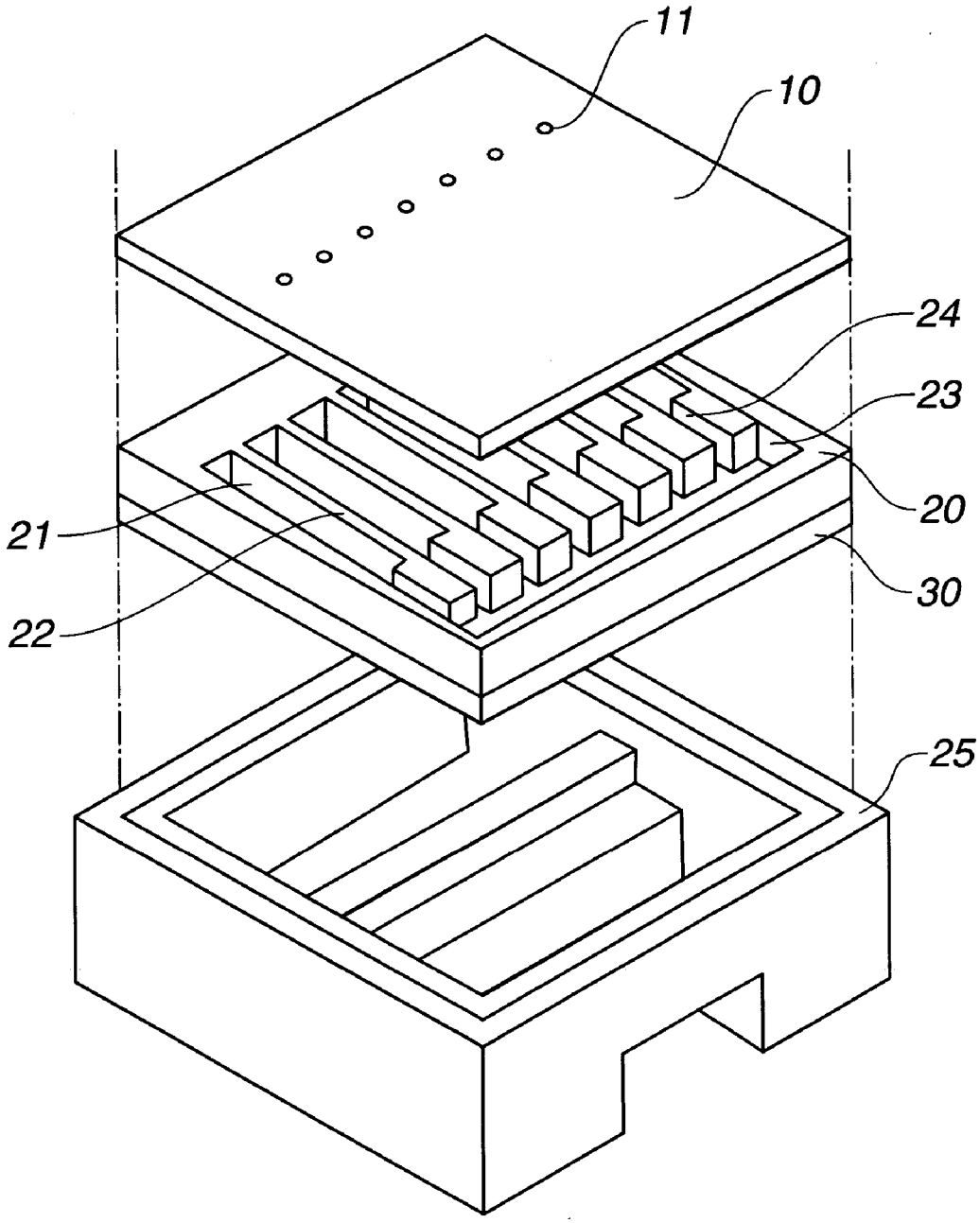
FIG. 2 is an exploded perspective view showing the constitution of the main parts of an inkjet recording head serving as the liquid jetting head according to an embodiment of the present invention.

FIG. 2 is an exploded perspective view showing the constitution of the main parts of an inkjet recording head serving as the liquid jetting head according to an embodiment of the present invention.

As shown in FIG. 2, the inkjet recording head comprises a nozzle plate 10, a pressure chamber substrate 20, and a diaphragm 30.

The pressure chamber substrate 20 comprises pressure chambers (cavities) 21, side walls 22, a reservoir 23, and supply ports 24. The pressure chambers 21 are storage spaces for discharging ink and the like, and are formed by etching a silicon substrate or the like. The side walls 22 are formed so as to partition the pressure chambers 21. The reservoir 23 is a common channel for supplying ink to each of the pressure chambers 21. The supply ports 24 are formed to be capable of leading ink into each of the pressure chambers 21 from the reservoir 23.

The nozzle plate 10 is bonded to one face of the pressure chamber substrate 20 such that nozzles 11 formed therein are disposed in positions corresponding to each of the pressure chambers 21 provided in the pressure chamber substrate 20.

The diaphragm 30 is formed by laminating a first oxide film 31 and a second oxide film 32 in the manner described below, and is formed on the other face of the pressure chamber substrate 20. An ink tank connection port not shown in the drawing is provided in the diaphragm 30 such that the ink which is stored in the ink tank can be supplied to the reservoir 23 of the pressure chamber substrate 20.

A head unit comprising the nozzle plate 10, diaphragm 30 and pressure chamber substrate 20 is mounted in a housing 25 and fixed therein, and constitutes the inkjet recording head 1.

[3. Constitution of Piezoelectric Element]

Figure 3:
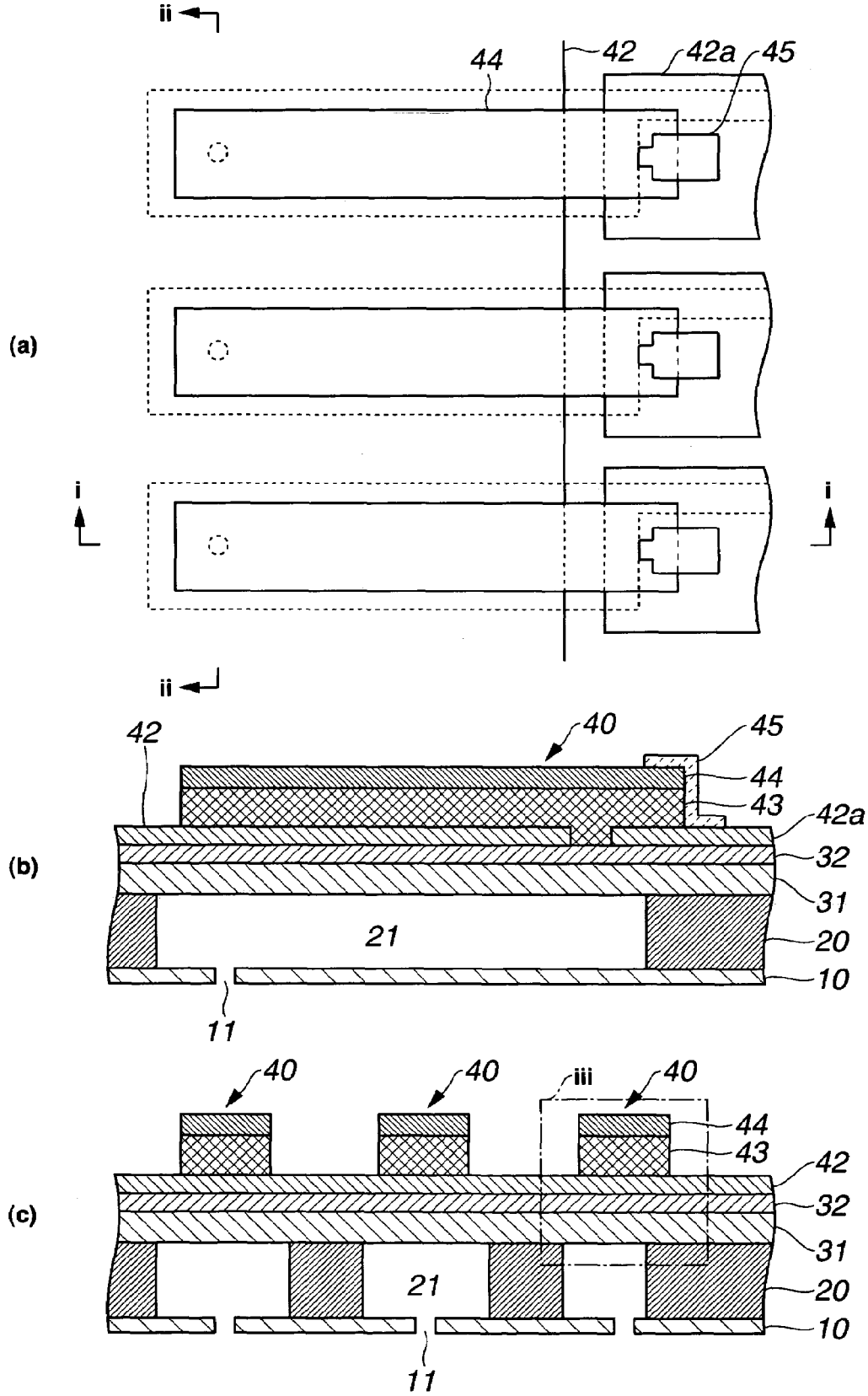
FIG. 3 is an enlarged plan view of a piezoelectric element part of the aforementioned inkjet recording head (a), a sectional view along a line i-i thereof (b), and a sectional view along a line ii-ii thereof (c)

FIG. 3 is an enlarged plan view of a piezoelectric element part of the aforementioned inkjet recording head (a), a sectional view along a line i-i thereof (b), and a sectional view along a line ii-ii thereof (c).

As shown in FIG. 3, a piezoelectric element 40 is constituted by the successive lamination onto the first oxide film 31 of the second oxide film 32, a bottom electrode 42, a piezoelectric thin film 43, and a top electrode 44.

The first oxide film 31 is formed as an insulating film on the pressure chamber substrate 20, which is constituted by monocrystalline silicon at a thickness of 100 μm, for example. The first oxide film 31 is preferably formed from a silica ($SiO_2$) film at a thickness of 1.0 μm.

The second oxide film 32 is a layer comprising elasticity, and is integrated with the first oxide film 31 to constitute the diaphragm 30. In order to provide elasticity to the diaphragm, the second oxide film 32 is preferably formed from a zirconia ($ZrO_2$) film at a thickness of no less than 200 nm and no more than 800 nm. The thickness is set at 500 nm, for example.

A metallic adhesive layer (not shown) preferably constituted by titanium or chromium may be provided between the second oxide film 32 and the bottom electrode 42 so as to adhere the two layers together. The adhesive layer is formed in order to improve the adhesiveness of the piezoelectric element to the disposal face, and hence need not be formed if this adhesiveness can be ensured. If provided, the adhesive layer is preferably set to a thickness of no less than 10 nm.

Here, the bottom electrode 42 has a layered constitution comprising at least a layer containing Ir. For example, from the bottom layer upward, the bottom electrode 42 comprises a layer containing Ir/a layer containing Pt/a layer containing Ir. The overall thickness of the bottom electrode 42 is set at 200 nm, for example.

The layered constitution of the bottom electrode 42 is not limited to the above example, and may be a two-layer constitution comprising a layer containing Ir/a layer containing Pt, or a layer containing Pt/a layer containing Ir. The bottom electrode 42 may also be constituted by a layer containing Ir alone.

The piezoelectric thin film 43 is a ferroelectric substance constituted by a piezoelectric ceramic crystal, and is preferably constituted by a ferroelectric piezoelectric material such as lead zirconate titanate (PZT) or PZT with a metallic oxide additive such asniobiumoxide, nickel oxide, or magnesium oxide. The composition of the piezoelectric thin film 43 may be selected appropriately in consideration of the characteristic of the piezoelectric element, the application, and so on. More specifically, lead titanate ($PbTiO_3$), lead zirconate titanate ($Pb(Zr, Ti)O_3$), lead zirconate ($PbZrO_3$), lanthanum-modified lead titanate ($(Pb, La)TiO_3$), lanthanum-modified lead zirconate titanate ($(Pb, La) (Zr, Ti)O_3$), lead zirconate titanate lead magnesium niobate ($Pb (Zr, Ti) (Mg, Nb)O_3$), and so on may be used favorably. Further, by appropriately adding niobium (Nb) to lead titanate or lead zirconate, a film with an excellent piezoelectric property may be obtained.

The piezoelectric thin film 43 is a film with a degree of (100) face orientation of at least 70%, and more preferably at least 80%, as measured by a wide-angle X-ray diffraction method. A (110) face orientation comprises 10% or less, and a (111) face orientation comprises the remainder. Note that the sum of the (100) face orientation, (110) face orientation, and (111) face orientation is set at 100%.

The thickness of the piezoelectric thin film 43 is suppressed to the extent that cracks are not caused in the manufacturing process. However, the film must be thick enough to exhibit a sufficient displacement characteristic, and hence the thickness is preferably set to no less than 0.5 μm and no more than 2.0 μm, for example to 1 μm.

The top electrode 44 opposes the bottom electrode 42, and is preferably constituted by Pt or Ir. The thickness of the top electrode 44 is preferably set to approximately 50 nm.

The bottom electrode 42 is common to each piezoelectric element. Conversely, a wiring bottom electrode 42*a* is positioned on a layer with an identical height to the bottom electrode 42, but is separated from the bottom electrode 42 and other wiring bottom electrodes 42*a*. The wiring bottom electrode 42*a* is capable of conduction with the top electrode 44 via a thin strip electrode 45.

Figure 4:
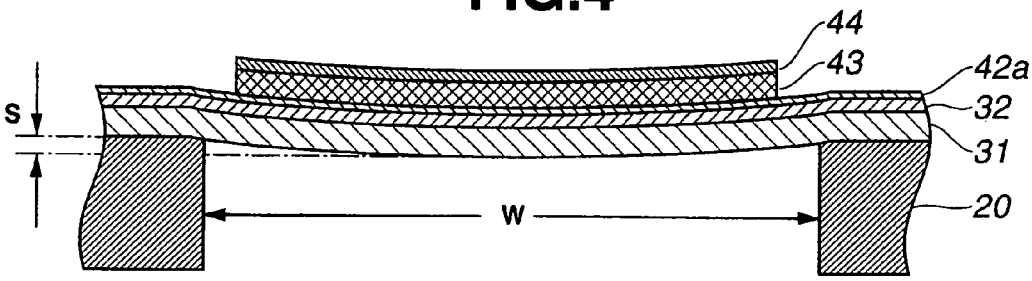
FIG. 4 is an enlarged view of the part of FIG. 3(*c*) surrounded by a line iii.

FIG. 4 is an enlarged view of the part of FIG. 3(*c*) surrounded by a line iii. FIG. 4 is closer to the film thickness ratio of this embodiment than FIG. 3(*c*), but particularly emphasizes bending S of the diaphragm. As shown in the drawing, a cavity width W is the length of the short side of the pressure chamber 21 on the plane near the diaphragm. The bending S is the amount of displacement of the diaphragm 30 when the voltage applied to the electrodes of the piezoelectric element 40 is zero. If the amount of displacement upon an applied voltage of zero is different immediately following manufacture and after a fixed number of uses, the bending S is preferably small even after usage.

[4. Operations of Ink Jet Recording Head]

A printing operation of the inkjet recording head 1 constituted as described above will now be described. When a driving signal is outputted from the control circuit 8, the paper supply mechanism 6 is operated to convey the paper 5 to a position at which printing can be performed by the head 1. If no discharge signal is issued from the control circuit 8 such that no driving voltage is applied between the bottom electrode 42 and top electrode 44 of the piezoelectric element, then no deformation occurs in the piezoelectric film 43. No pressure change occurs in the pressure chamber 21 provided with the piezoelectric element to which no discharge signal has been issued, and no ink droplets are discharged from the corresponding nozzle 11.

If, on the other hand, a discharge signal 8 is issued from the control circuit 8 and a constant driving voltage is applied between the bottom electrode 42 and top electrode 44 of the piezoelectric element, deformation of the piezoelectric film 43 occurs. The diaphragm 30 of the pressure chamber 21 provided with the piezoelectric element to which the discharge signal has been issued warps greatly toward the inside of the pressure chamber, as a result of which the pressure inside the pressure chamber 21 rises momentarily and ink droplets are discharged from the nozzle 11. By issuing discharge signals individually to the piezoelectric element in a position within the head which corresponds to the printing data, desired alphanumerical characters and shapes can be printed.

[5. Method of Manufacture]

Figure 5:
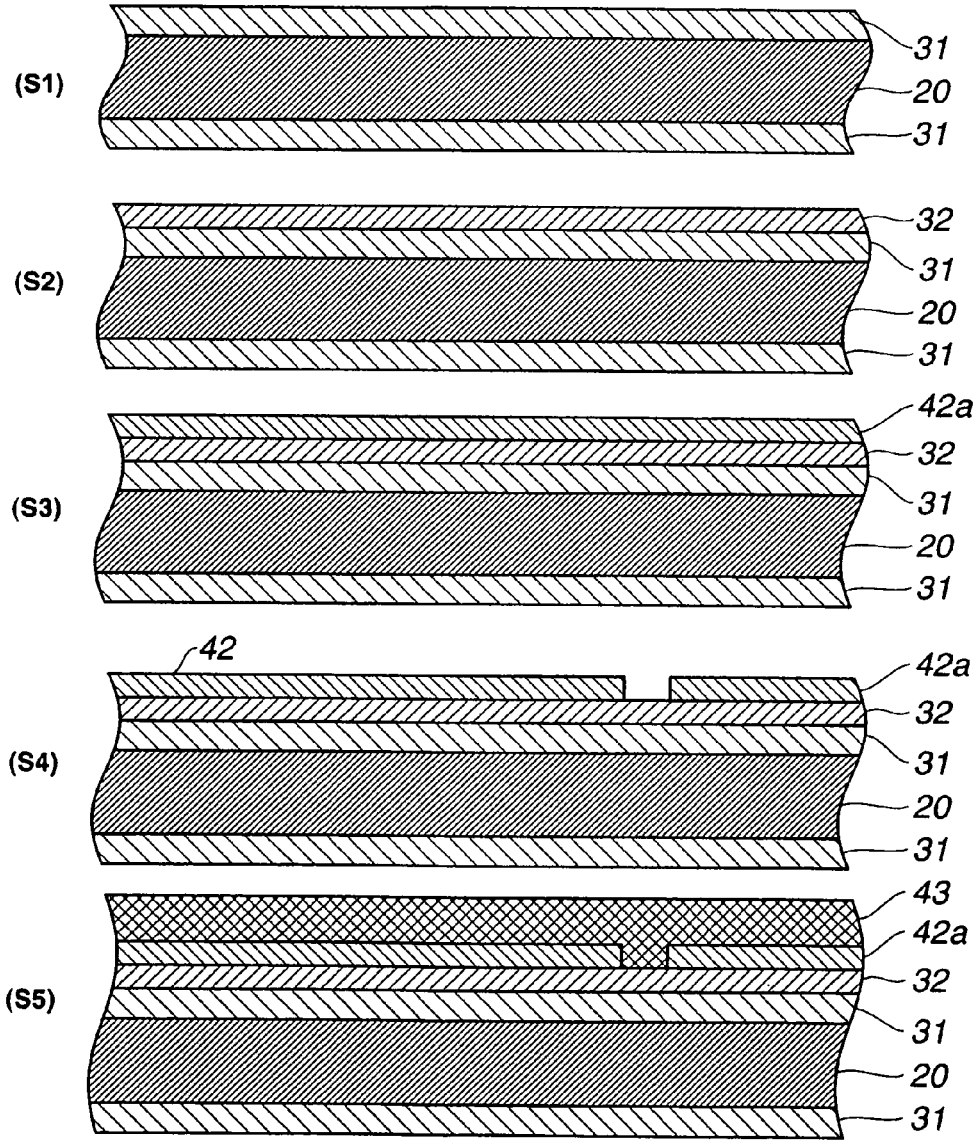
FIG. 5 is a sectional pattern diagram showing a manufacturing method of the inkjet recording head serving as the liquid jetting head of the present invention.
Figure 6:
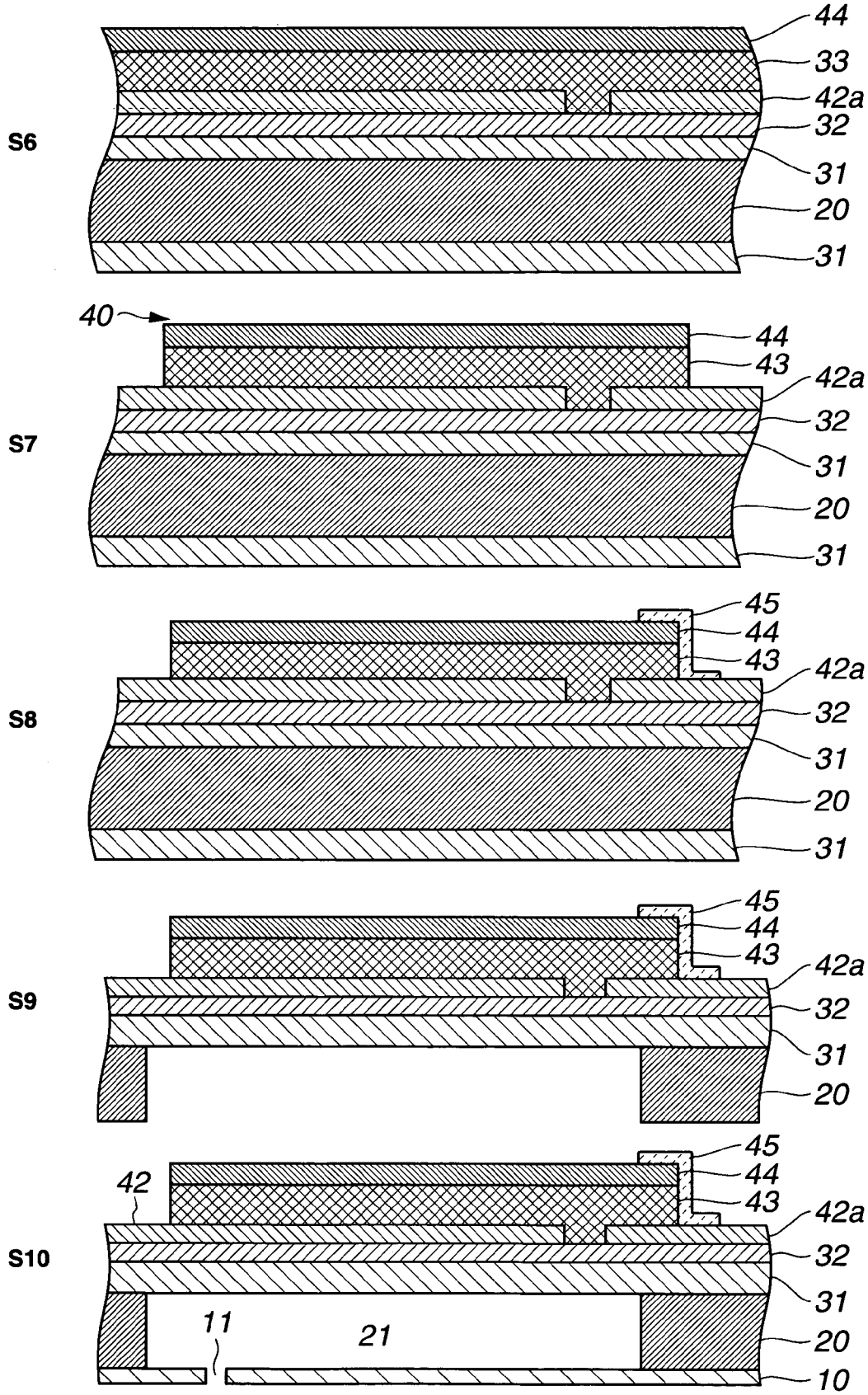
FIG. 6 is a sectional pattern diagram showing a manufacturing method of the inkjet recording head serving as the liquid jetting head of the present invention.

Next, a method of manufacturing the piezoelectric element of the present invention will be described. FIGS. 5 and 6 are sectional pattern diagrams showing a manufacturing method of the piezoelectric element and inkjet recording head of the present invention.

First Oxide Film Formation Step (S1)

In this step, a silicon substrate to be formed into the pressure chamber substrate 20 is subjected to high-temperature processing in an oxidizing atmosphere containing oxygen or steam, whereby the first oxide film 31 is formed from silica ($SiO_2$). Instead of a thermal oxidation method typically used in this step, a CVD method may be used. When a thermal oxidation method is used, compressive stress is likely to occur inside the first oxide film, and it has been conjectured that this is another cause of the bending S of the diaphragm.

Second Oxide Film Formation Step (S2)

This is a step for forming the second oxide film 32 on one face of the pressure chamber substrate 20 formed with the first oxide film 31. The second oxide film 32 is obtained by subjecting the pressure chamber substrate 20 formed with a Zr layer by a sputtering method, vacuum deposition method, or the like to high-temperature processing in an oxygen atmosphere.

Bottom Electrode Formation Step (S3)

In this step, the bottom electrode 42 is formed on the second oxide film 32. For example, a layer containing Ir is formed, then a layer containing Pt is formed, and then another layer containing Ir is formed.

Each of the layers constituting the bottom electrode 42 is formed by attaching Ir or Pt respectively onto the second oxide film 32 by a sputtering method or the like. Note that an adhesive layer (not shown) formed from titanium or chromium may be formed by a sputtering method or vacuum deposition method prior to the formation of the bottom electrode 42.

In the bottom electrode formation step, tensile stress is likely to occur inside the bottom electrode 42, and it has been conjectured that this is also a cause of the bending S of the diaphragm 30 and piezoelectric element 40.

Patterning Step Following Formation of Bottom Electrode (S4)

In order to separate the bottom electrode 42 from the wiring electrode 42*a* after the bottom electrode is formed, first a mask is applied to the bottom electrode layer 42 in a desired form, and then patterning is performed by etching around the mask. More specifically, first a resist material is applied at a uniform thickness onto the surface of the bottom electrode using a spinning method, spraying method, or similar (not shown). A mask is then formed in the shape of the piezoelectric element, the mask is exposed and developed, and thus a resist pattern is formed on the bottom electrode (not shown). The resist pattern is then removed by etching using a typical ion milling method, dry etching method, or similar, thereby exposing the second oxide film 32.

Further, cleaning by reverse sputtering (not shown) is performed during this patterning step in order to remove contaminants, oxidized parts, and so on that have become attached to the surface of the bottom electrode.

Ti Core (Layer) Formation Step

In this step, a Ti core (layer) (not shown) is formed on the bottom electrode 42 by a sputtering method or the like. The reason for forming the Ti core (layer) is to obtain a precise and columnar crystal by growing PZT with a Ti crystal as the core such that crystal growth occurs from the bottom electrode side. By adjusting the thickness of the Ti core (layer), the degree of (100) face orientation of the PZT constituting the piezoelectric thin film can be controlled. The average thickness of the Ti core (layer) is set between 3 nm and 7 nm, for example.

Piezoelectric Thin Film Formation Step (S5)

The piezoelectric thin film 43 is manufactured by a sol-gel method to be described below, for example.

First, a sol constituted by an organic metal alkoxide solution is applied onto the Ti core by a coating method such as spin-coating. Next, the sol is dried at a fixed temperature for a fixed length of time, whereby the solution is vaporized. Following drying, degreasing is performed at a fixed temperature and for a fixed length of time under normal atmospheric conditions, whereby organic ligands bonded to the metal are caused to thermally decompose, and are thereby made into metal oxide. The respective steps of application, drying, and degreasing are repeated a predetermined number of times, for example twice, in order to laminate a two-layered piezoelectric precursor film. As a result of the drying and degreasing processes, metal alkoxide and acetate in the solution form a network of metal, oxygen, and metal through the thermal decomposition of the ligands.

After its formation, the piezoelectric precursor film is crystallized through calcination, and thus the piezoelectric thin film is formed. As a result of this calcination, the piezoelectric precursor film changes from an amorphous state to take a rhombohedral crystal structure, and changes into a piezoelectric thin film exhibiting electromechanical transducing behavior in which the degree of (100) face orientation, as measured by a wide-angle X-ray diffraction method, is 80%.

By repeating such formation and calcination processes of the precursor film multiple times, the piezoelectric thin film can be set to a desired film thickness. For example, the film thickness of the precursor film that is applied in each calcination process is set at 200 nm, and this is repeated five times. The layer that is formed by calcination from the second time onward is crystallized under the influence of the successive lower layers of piezoelectric film, and thus the degree of (100) face orientation is set at 80% over the entire piezoelectric thin film.

In the piezoelectric thin film formation step, tensile stress is likely to occur inside the piezoelectric thin film 43, and it has been conjectured that this is also a cause of the bending S in the diaphragm 30 and piezoelectric element 40. Note that by setting the degree of (100) face orientation to 70% or more, the amount of bending S can be reduced as will be described below. The amount of bending S can also be reduced by constituting the piezoelectric thin film from multi-component PZT, as will be described below.

Top Electrode Formation Step (S6)

The top electrode 44 is formed on the piezoelectric thin film 43 by an electronic beam deposition method or a sputtering method.

Piezoelectric Thin Film and Top Electrode Removal Step (S7)

In this step, the piezoelectric thin film 43 and top electrode 44 are patterned into the predetermined shape of the piezoelectric element. More specifically, resist is spin-coated onto the top electrode 44 and then patterned by exposure and development to be aligned with the position in which the pressure chamber is to be formed. The remaining resist is then used as a mask in the etching of the top electrode 44 and piezoelectric thin film 43 by ion milling or the like. As a result of this process, the piezoelectric element 40 is formed.

Thin Strip Electrode Formation Step (S8)

Next, the thin strip electrode 45 for enabling conduction between the top electrode 44 and wiring bottom electrode 42*a* is formed. The material of the thin strip electrode 45 is preferably a metal with low rigidity and low electrical resistance. Aluminum, copper, and so on are also suitable. The thin strip electrode 45 is formed at a film thickness of approximately 0.2 μm and then patterned such that the conduction portions between each of the top electrodes and the wiring bottom electrodes remain.

Pressure Chamber Formation Step (S9)

Next, anisotropic etching using an active gas, such as anisotropic etching or parallel plate reactive ion etching, is implemented on the other face of the pressure chamber substrate 20 to form the pressure chambers 21 in the parts corresponding to the formation locations of the piezoelectric elements 40. The remaining non-etched parts become the side walls 22.

Prior to the formation of the pressure chambers 21, the pressure chamber substrate 20 keeps the first oxide film 31 and piezoelectric thin film 43 flat against the internal stress produced during the manufacturing processes thereof. When the pressure chamber substrate 20 is subject to removal by etching, however, bending S (initial bending) occurs in the diaphragm 30 and piezoelectric element 40 at the removed parts. Internal stress in the first oxide film 31 can be considered a cause of this bending S, and hence it is believed that by etching the first oxide film 31 following the formation of the pressure chambers such that the film thickness is partially reduced, internal stress can be reduced, leading to a reduction in the bending S.

Nozzle Plate Adhesion Step (S10)

Finally, a nozzle plate 10 is adhered to the etched pressure chamber substrate 20 with an adhesive. When this adhesion is performed, the respective nozzles 11 are positioned so as to be disposed in the spaces in each of the pressure chambers 21. The pressure chamber substrate 20 with the nozzle plate 10 adhered thereto is attached to casing not shown in the drawing, and thus the inkjet recording head 1 is completed.

6. EXAMPLE 1

The inkjet recording head of the embodiment described above was manufactured with varying degrees of (100) face orientation of the PZT which serves as the piezoelectric thin film. By adjusting the thickness of the Ti core formed on the bottom electrode, inkjet recording heads with 8%, 33%, and 79% degrees of PZT (100) face orientation respectively were obtained. In each head, the cavity width W was set at 65 μm.

For each of these inkjet recording heads, measurements of the bending S of the diaphragm directly after manufacture (initial bending), and the bending S of the diaphragm when the applied voltage was set at zero following the application of one hundred million pulses of a 20V trapezoidal wave (post-driving bending) were taken.

In the head having an 8% (100) face orientation, the initial bending S was 230 nm, and the post-driving bending S was 280 nm. In the head having a 33% (100) face orientation, the initial bending S was 130 nm, and the post-driving bending S was 280 nm. In the head having a 79% (100) face orientation, the initial bending S was 100 nm, and the post-driving bending S was 220 nm.

As described above, in the head with the 79% (100) face orientation, the bending S remained within 0.4% of the cavity width W even after voltage application, thus displaying a favorable result.

7. EXAMPLE 2

A measurement of the bending S in the inkjet recording head of the embodiment described above using multi-component PZT as the piezoelectric thin film was taken. More specifically, an inkjet recording head with the piezoelectric thin film 43 constituted by lead zirconate lead titanate lead nickel niobate lead zirconate niobate, which is expressed as 0.47 $PbZrO_3$–0.43 $PbTiO_3$–0.05Pb $(Ni_{1/3}Nb_{2/3})O_3$–0.05 Pb $(Zr_{1/3}Nb_{2/3})O_3$, was used. As in Example 1, the cavity width W was set at 65 μm. The initial bending S was 176 nm, and the post-driving bending S was 187 nm, and hence in both cases, the bending S was no more than 0.4% of the cavity width W.

[8. Other Applications]

The liquid jetting head of the present invention may be applied to various heads for discharging a liquid other than a head for discharging ink used in an inkjet recording device, for example a head for discharging liquid containing coloring material used in the manufacture of color filters for liquid crystal displays and the like, a head for discharging liquid containing electrode material used to form electrodes for organic EL displays, FEDs (field emission displays), and the like, a head for discharging liquid containing bioorganic substances used in the manufacture of biochips, and so on.

INDUSTRIAL APPLICABILITY

According to the present invention, a liquid jetting head using a piezoelectric element which is capable of obtaining sufficient displacement through the application of a driving voltage can be provided.

The invention claimed is:

1. A liquid jetting head, comprising:

a substrate formed with a pressure chamber;

a diaphragm formed on the substrate, said diaphragm comprising:

a first oxide film; and a second oxide film;

wherein said first oxide film consists of $SiO_2$; and a piezoelectric thin film element formed on the diaphragm, wherein said diaphragm bends a first amount in convex form toward said pressure chamber side after manufacture, and bends a second amount in convex form toward said pressure chamber side after a voltage application is completed and an applied voltage is set to zero, wherein the second amount by which said diaphragm bends is no more than 0.4% of the width of said pressure chamber, and wherein said piezoelectric thin film element comprises a piezoelectric thin film constituted by PZT with a degree of (100) face orientation of at least 80%.

2. The liquid jetting head according to claim 1, wherein said piezoelectric thin film element comprises a piezoelectric thin film constituted by multi-component PZT containing at least Pb $(Zr_{1/3}Nb_{2/3})O_3$.

3. The liquid jetting head according to claim 1, wherein said diaphragm has a partially reduced thickness adjacent said pressure chamber.

4. The liquid jetting head according to claim 1, wherein said piezoelectric thin film element comprises a piezoelectric thin film having a film thickness of no less than 0.5 μm and no more than 2.0 μm.

5. A liquid discharging device comprising the liquid jetting head of claim 1.

6. The liquid jetting head according to claim 2, wherein said diaphragm has a partially reduced thickness adjacent said pressure chamber.

7. A liquid discharging device comprising the liquid jetting head of claim 2.

8. A liquid discharging device comprising the liquid jetting head of claim 3.

9. A liquid discharging device comprising the liquid jetting head of claim 4.

* * * * *